US011155980B2

(12) United States Patent
Myhre

(10) Patent No.: US 11,155,980 B2
(45) Date of Patent: Oct. 26, 2021

(54) CHISEL ARRANGEMENT FOR EXCAVATOR

(71) Applicant: Per Jørgen Myhre, Sagvåg (NO)

(72) Inventor: Per Jørgen Myhre, Sagvåg (NO)

( * ) Notice: Subject to any disclaimer, the term of this patent is extended or adjusted under 35 U.S.C. 154(b) by 0 days.

(21) Appl. No.: 16/603,760

(22) PCT Filed: May 8, 2018

(86) PCT No.: PCT/NO2018/050121

§ 371 (c)(1),
(2) Date: Oct. 8, 2019

(87) PCT Pub. No.: WO2018/208170

PCT Pub. Date: Nov. 15, 2018

(65) Prior Publication Data

US 2020/0131733 A1 Apr. 30, 2020

(30) Foreign Application Priority Data

May 9, 2017 (NO) ..... 20170761
May 4, 2018 (NO) ..... 20180640

(51) Int. Cl.
*E02F 3/96* (2006.01)
*E02F 3/40* (2006.01)

(52) U.S. Cl.
CPC ..... *E02F 3/962* (2013.01); *E02F 3/966* (2013.01); *E02F 3/40* (2013.01); *E02F 3/961* (2013.01)

(58) Field of Classification Search
CPC ..... B25D 17/005; B25D 17/00; E02F 3/966; E02F 3/962; E02F 3/40; E02F 3/961;
(Continued)

(56) References Cited

U.S. PATENT DOCUMENTS 2,873,542 A * 2/1959 Codlin ..... E02F 3/7613 172/799.5
2,983,496 A * 5/1961 Grant ..... E02F 3/966 299/67

(Continued)

FOREIGN PATENT DOCUMENTS

AU 559417 3/1987
CN 102261085 11/2011

(Continued)

OTHER PUBLICATIONS

Norwegian Search Report for 20170761, dated Dec. 9, 2017.

(Continued)

*Primary Examiner* — Janine M Kreck
*Assistant Examiner* — Michael A Goodwin
(74) *Attorney, Agent, or Firm* — Andrus Intellectual Property Law, LLP

(57) ABSTRACT

A chisel arrangement is arranged to be connected to a pivotal tool mount on a work machine. A pivot axis of the tool mount forms an operative pivot axis of the chisel arrangement. The chisel arrangement includes a housing provided with a coupling portion which is arranged to be attachable to the tool mount. A reciprocatable chisel projects from an end portion of the housing. A clearing blade is rigidly attached to the housing remotely from the end portion and projects from the periphery of the housing and is provided with a forward edge which is substantially parallel to the operative pivot axis of the chisel arrangement.

11 Claims, 2 Drawing Sheets

(58) Field of Classification Search
CPC .. E01C 23/0926; E01C 23/122; E01C 23/124; E04G 23/082
See application file for complete search history.

(56) References Cited

U.S. PATENT DOCUMENTS

| | | | | | |
|---|---|---|---|---|---|
| 3,997,068 | A * | 12/1976 | Lock | E02F 3/40 414/723 |
| 4,023,288 | A * | 5/1977 | Roe | E02D 3/032 37/403 |
| 4,602,821 | A | 7/1986 | Schaeff | |
| 4,974,349 | A * | 12/1990 | Timmons | E02D 3/026 37/379 |
| 5,062,228 | A * | 11/1991 | Artzberger | E02F 5/30 37/407 |
| 5,244,306 | A * | 9/1993 | Artzberger | E02F 3/967 37/403 |
| 5,404,660 | A * | 4/1995 | Webster | E02F 3/20 172/247 |
| 2008/0047171 | A1* | 2/2008 | Jalabert | E02F 3/966 37/403 |

FOREIGN PATENT DOCUMENTS

| | | |
|---|---|---|
| FR | 2866362 | 8/2005 |
| GB | 1449120 | 9/1976 |
| GB | 1482357 | 8/1977 |
| JP | S53105333 U | 8/1978 |
| JP | 01252375 | 10/1989 |
| KR | 200361015 | 9/2004 |
| KR | 20160067339 | 6/2016 |

OTHER PUBLICATIONS

Norwegian Search Report for 20180640, dated Sep. 7, 2018.
International Search Report and the Written Opinion for PCT/NO2018/050121, dated Jul. 26, 2018.
Response to the Written Opinion for PCT/NO2018/050121, dated Oct. 31, 2018.
Written Opinion for PCT/NO2018/050121, dated Jan. 22, 2019.
International Preliminary Report on Patentability for PCT/NO2018/050121, dated Jul. 3, 2019.
Supplementary European Search Report for European Patent Application No. 18799255.7, dated Feb. 8, 2021.

* cited by examiner

CHISEL ARRANGEMENT FOR EXCAVATOR

CROSS-REFERENCE TO RELATED APPLICATIONS

This application is the U.S. national stage application of International Application PCT/NO2018/050121, filed May 8, 2018, which international application was published on Nov. 15, 2018, as International Publication WO 2018/208170 in the English language. The International Application claims priority of Norwegian Patent Application Nos. 20180640, filed May 4, 2018 and 20170761, filed May 9, 2017. The international application and Norwegian applications are all incorporated herein by reference, in entirety.

BACKGROUND

A hydraulic chisel is used for splitting rock, concrete and other solid materials, the chisel being connected to the arm of an excavator, for example, and being driven by the hydraulic system integrated in the machine to which the chisel is connected. The chisel is elongated and relatively slim and is not very suitable for moving the split material.

U.S. Pat. No. 4,602,821 A discloses a hydraulic chisel provided with a clearing scraper or a clearing shovel which is pivotal or displaceable between an inactive, locked position along the housing and an active, locked position in which a forward edge projects beyond the end portion of the chisel, the clearing scraper or clearing shovel being suitable for removing the crushed material.

KR 20160067339 A discloses a clearing scraper which is hydraulically displaceable along the chisel housing in guides arranged on the chisel housing between a retracted, inactive position and an extended, active position in which a forward edge projects beyond the end portion of the chisel for the removal of the divided material.

From JP H01252375 A, a clearing scraper arranged on a chisel housing is known, hydraulically pivotal between an inactive position along the chisel housing and an active position in which the clearing scraper extends along the chisel and beyond the end of the chisel.

AU 559417 B2 discloses a clearing scraper which is pivotal between an inactive, locked position along a chisel housing and a working position in which it extends along the chisel. The chisel may be released from its locked, inactive position by remote control of a locking device.

A drawback of clearing scrapers that are displaceable or rotatable relative to the chisel housing is that the assembly of the chisel housing and clearing scraper must include complicated and vulnerable functions to enable change-over of the clearing scraper.

SUMMARY

The invention has for its object to remedy or reduce at least one of the drawbacks of the prior art or at least provide a useful alternative to the prior art.

The object is achieved through the features that are specified in the description below and in the claims that follow.

The invention provides a chisel arrangement arranged to be fitted at a tool mount on a work machine, especially an excavator, provided with a tool manipulator in which a clearing blade is rigidly attached to a housing, the clearing blade projecting from the periphery of the housing and being provided with a forward edge which is substantially parallel to the pivot axis of the tool mount, which is also the operative pivot axis of the chisel arrangement. When the chisel arrangement is in a normal position, that is to say with the chisel pointing towards the surface that is to be broken up, the clearing blade has good clearance to the surface and does not prevent the chisel from working the surface. When loosened material is to be removed from the work area of the chisel, the chisel arrangement is tilted around the pivot axis of the tool mount, so that the clearing blade has its forward edge facing the surface, and the loosened material is pushed away so that the surface is exposed and ready for further chiselling.

Preferably, the clearing blade is arranged in the immediate vicinity of a coupling portion arranged to connect the chisel arrangement and the tool mount. The clearing blade may be integrated in the coupling portion.

Preferably, the clearing blade has a working width which is larger than the extent, in terms of width, of the tool mount.

Preferably, the clearing blade is formed of a plate element provided with reinforcing ribs extending from the forward edge of the clearing blade.

It is an advantage if the clearing blade is provided with side walls extending from the forward edge and forming at least some of the reinforcing ribs of the clearing blade.

The clearing blade may be provided with a wear part in the form of a replaceable front piece.

The invention is defined by the independent claim. The dependent claims define advantageous embodiments of the invention.

More specifically, the invention relates to a chisel arrangement arranged to be connected to a pivotal tool mount on the rotatable tool mount of a work machine, wherein a pivot axis of the tool mount forms an operative pivot axis of the chisel arrangement, and wherein the chisel arrangement includes

- a housing provided with a coupling portion which is arranged to be attachable to the tool mount,
- a reciprocatable chisel projecting from an end portion of the housing, characterized by
- a clearing blade being rigidly attached to the housing at a distance from said end portion and projecting from the periphery of the housing at an angle to the longitudinal axis of the chisel and being provided with a forward edge which is substantially parallel to the operative pivot axis of the chisel arrangement, the position of the clearing blade relative the housing being unchanged while the chisel arrangement is tilted from a chiselling position to a clearing position, and vice versa.

The clearing blade may be attached in the immediate vicinity of the coupling portion.

The clearing blade may be attached to the coupling portion.

The forward edge of the clearing blade may have an extent that exceeds the width of the tool mount.

The forward edge of the clearing blade may be parallel to the pivot axis of the tool mount.

The clearing blade may include a blade plate which is provided with several reinforcing ribs.

The clearing blade may include a blade plate, on which reinforcing ribs form side walls on the blade plate.

The forward edge may be formed of at least one replaceable front piece.

The forward edge of the clearing blade may have a distance from the housing of 20 cm minimum.

BRIEF DESCRIPTION OF THE DRAWINGS

In what follows, examples of preferred embodiments are described, which are visualized in the accompanying drawings, in which.

DETAILED DESCRIPTION OF THE DRAWINGS

Figure 1:
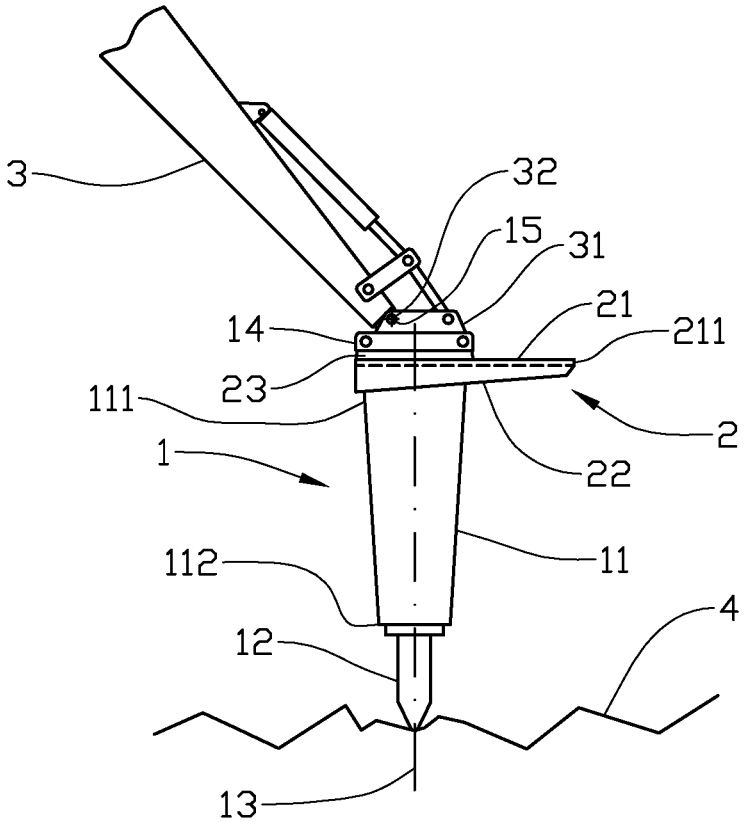
FIG. 1 shows a side view of a chisel arrangement attached to an excavator arm and provided with a clearing blade, the chisel arrangement being shown in a first position for chiselling.

Reference is first made to FIG. 1. A chisel arrangement 1 of a kind known per se includes a housing 11 which, in a first end portion 111, includes a coupling portion 14 arranged for releasable connection to a tool mount 31 on a work machine 3, shown here as an arm on an excavator. A reciprocatable chisel 12 projects from a second end portion 112 of the housing 11. In a manner known per se, the housing 11 accommodates a driving device, not shown, for the chisel 12, typically a hydraulic driving device driven by the hydraulic system (not shown) of the work machine 3. The longitudinal axis 13 of the chisel is perpendicular to the operative pivot axis 15 of the chisel arrangement 1. Said operative pivot axis 15 is formed of a rotational axis 32 of the tool mount 31 relative to the work machine 3.

A clearing blade 2 is attached to the chisel arrangement 1 at the first end portion 111 of the housing, shown here as attached to the coupling portion 14 by means of blade attachments 23. In an embodiment not shown, the clearing blade 2 may be integrated in the coupling portion 14.

The clearing blade 2 projects rigidly from the periphery of the housing 11, shown perpendicular to the longitudinal axis 13 of the chisel 12 here. The angle of the clearing blade 2 relative to said longitudinal axis 13 may be adjustable.

The clearing blade 2 is formed of a blade plate 21 which is provided with a forward edge 211. The blade plate 21 is preferably braced by means of reinforcing ribs 22, shown here as two opposite side walls extending from the forward edge 211 backwards for the entire extent of the blade plate 21. In the embodiment shown, the blade plate 21 extends on both sides along the entire coupling portion 14.

The clearing blade 2 may have a width that exceeds the width of the housing 11 and the coupling portion 14.

Figure 3:
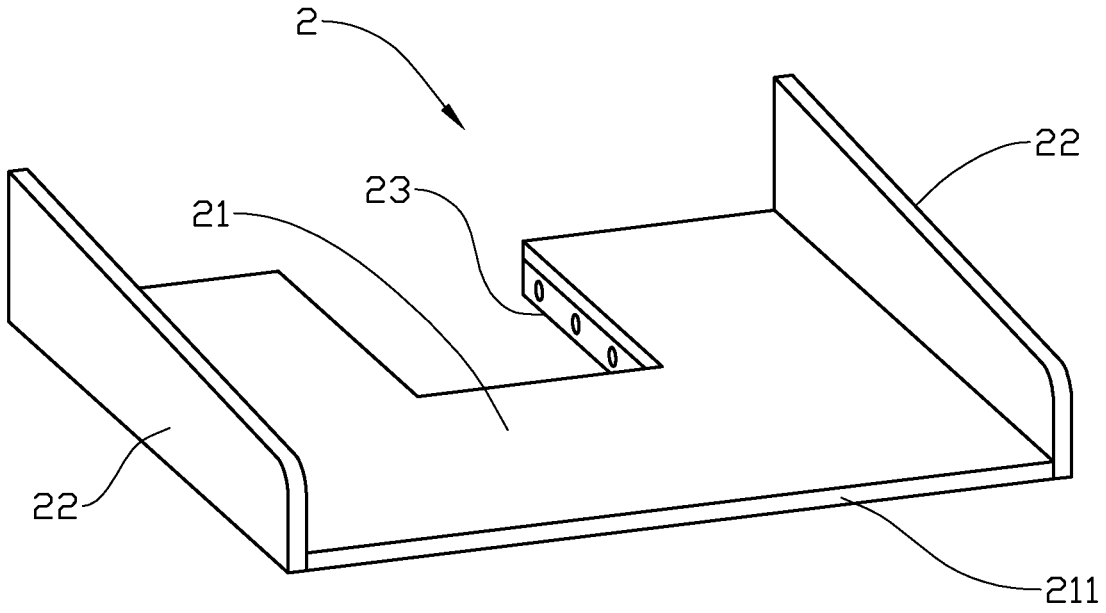
FIG. 3 shows a perspective drawing, on a larger scale, of the clearing blade.

The clearing blade 2 is shown in more detail in FIG. 3.

Figure 4:
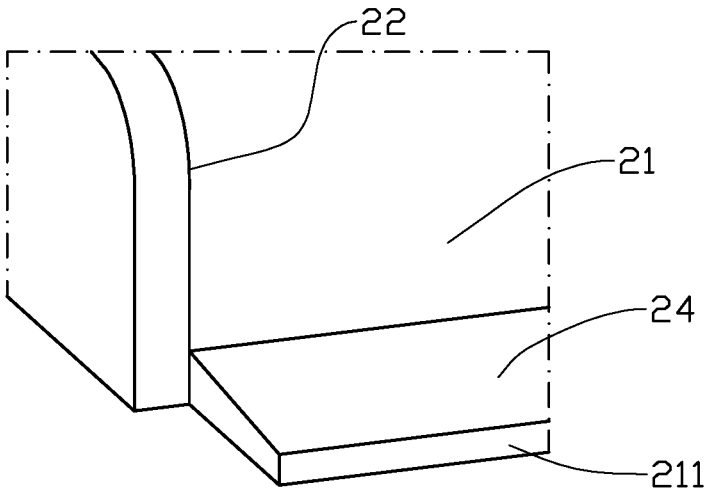
FIG. 4 shows a perspective drawing, on a larger scale, of a section of the clearing blade provided with a replaceable front piece.

In an alternative embodiment, the blade plate 21 is provided with a replaceable front piece 24 which forms the forward edge 211 of the clearing blade 2, see FIG. 4. The front piece 24 may be a multipart one and may be attached to the blade plate 21 by means of welds or screws or other suitable fastening means.

Figure 2:
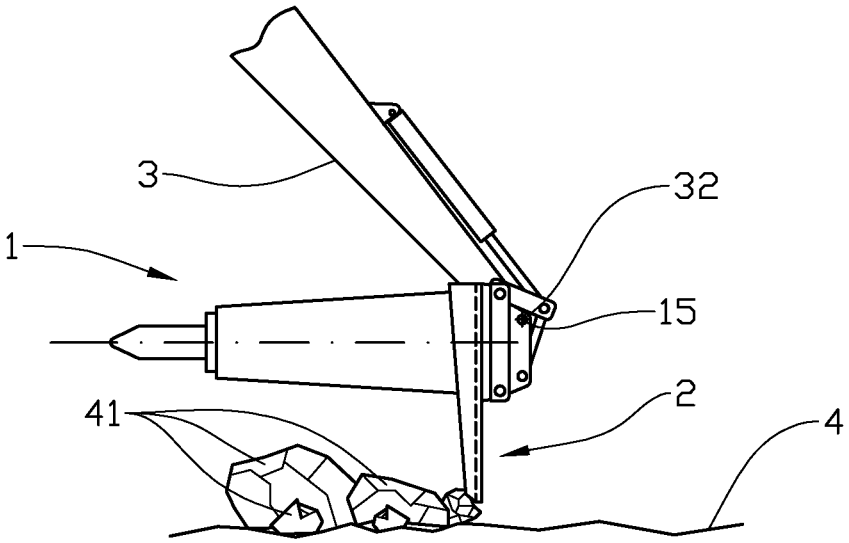
FIG. 2 shows a view corresponding to FIG. 1, the chisel arrangement being shown in a second position for moving loosened material.

When chiselling a surface 4, the chisel arrangement 1 is set with the chisel 12 pointing towards the surface 4, as is shown in FIG. 1. The material 41 is broken loose from the surface, and the loosened material 41 is removed from the surface 4 of the work area by the chisel arrangement 1 being tilted around the pivot axis 15 into the position shown in FIG. 2, as the chisel arrangement 1 is lowered towards the loosened material 41 which is then pushed away by means of the clearing blade 2 as the chisel arrangement 1 and the clearing blade are moved parallel to the surface 4. When the surface 4 at the work area is exposed, the chisel arrangement 1 is re-adjusted to the position shown in FIG. 1, and the chiselling of the surface 4 may continue.

It should be noted that all the above-mentioned embodiments illustrate the invention, but do not limit it, and persons skilled in the art may construct many alternative embodiments without departing from the scope of the attached claims. In the claims, reference numbers in brackets are not to be regarded as restrictive.

The use of the verb "to comprise" and its different forms does not exclude the presence of elements or steps that are not mentioned in the claims. The indefinite article "a" or "an" before an element does not exclude the presence of several such elements.

The fact that some features are indicated in mutually different dependent claims does not indicate that a combination of these features cannot be used with advantage.

The invention claimed is:

1. A chisel arrangement for chiseling a work surface, the chisel arrangement comprising:

a work machine;

a housing having a first end portion pivotably coupled to the work machine along rotational axis, and an opposite, second end portion comprising a reciprocal chisel that is operated by the work machine, wherein the housing extends from the first end portion to the second end portion along a longitudinal axis that is perpendicular to the rotational axis; and a clearing blade rigidly coupled to the housing at the first end portion, the clearing blade extending from a periphery of the housing, outwardly relative to the work machine, and transversely to the rotational axis and transversely to the longitudinal axis;

wherein the chisel arrangement is configured such that material which is broken loose from the work surface via the reciprocal chisel is cleared from the work surface by pivoting the housing about the rotational axis, upwardly towards the work machine, which pivots the clearing blade downwardly about the rotational axis towards the work surface, and then by moving the clearing blade generally parallel to the work surface.

2. The chisel arrangement according to claim 1, wherein the clearing blade extends perpendicularly relative to the rotational axis and perpendicularly relative to the longitudinal axis.

3. The chisel arrangement according to claim 1, wherein the clearing blade extends at an adjustable angle relative to the longitudinal axis.

4. The chisel arrangement according to claim 1, wherein the clearing blade has a width that exceeds a width of the housing.

5. The chisel arrangement according to claim 1, wherein the clearing blade is integrated with the housing.

6. The chisel arrangement according to claim 1, wherein the clearing blade comprises a blade plate having a forward edge.

7. The chisel arrangement according to claim 6, further comprising reinforcing ribs that reinforce the blade plate.

8. The chisel arrangement according to claim 7, wherein the reinforcing ribs comprise opposing sidewalls extending from the forward edge, along an entire extent of the blade plate.

9. The chisel arrangement according to claim 6, wherein the blade plate comprises a replaceable front piece forming the forward edge of the blade plate.

10. The chisel arrangement according to claim 9, wherein the replaceable front piece is a wear part.

11. The chisel arrangement according to claim 9, wherein the forward edge of the blade plate is located at a distance from the housing of at least 20 centimeters.

* * * * *